US011324345B2

(12) United States Patent
Oehlert

(10) Patent No.: US 11,324,345 B2
(45) Date of Patent: May 10, 2022

(54) CLANDESTINE ARTICULATING UTENSIL

(71) Applicant: Jeremy Oehlert, Pittsburg, KS (US)

(72) Inventor: Jeremy Oehlert, Pittsburg, KS (US)

( * ) Notice: Subject to any disclaimer, the term of this patent is extended or adjusted under 35 U.S.C. 154(b) by 0 days.

(21) Appl. No.: 16/852,490

(22) Filed: Apr. 19, 2020

(65) Prior Publication Data

US 2021/0321804 A1 Oct. 21, 2021

(51) Int. Cl.
*A47G 21/02* (2006.01)
*A47G 21/04* (2006.01)

(52) U.S. Cl.
CPC ..... *A47G 21/02* (2013.01); *A47G 21/023* (2013.01); *A47G 21/04* (2013.01)

(58) Field of Classification Search
CPC ..... A47G 21/02–026; A47G 21/04; A47G 21/045; A47J 43/28; A47J 43/281; A47J 43/282; A47J 43/287
USPC ..... D7/401.2, 642–656; 30/147–150, 30/322–328; D4/104–114; 15/167.1
See application file for complete search history.

(56) References Cited

U.S. PATENT DOCUMENTS

D128,681 S * 8/1941 Reinold ..... D4/107
2,787,055 A 4/1957 Wertz
2,833,084 A * 5/1958 Hlousek ..... A47G 21/04 D7/656
2,839,830 A * 6/1958 Neiman, Jr. ..... A47G 21/06 30/147
D191,096 S * 8/1961 Gordon et al. ..... D4/107
3,612,358 A * 10/1971 Massa ..... A61J 7/0046 D7/653
3,820,196 A * 6/1974 Penman ..... A22C 25/16 D7/644
3,839,793 A * 10/1974 Crapio ..... A47G 21/02 D7/657
D237,659 S * 11/1975 Meyer et al. ..... D4/107
D274,971 S * 8/1984 Kelley ..... D7/656
D286,901 S * 11/1986 Ohno ..... D21/615
D287,038 S * 12/1986 Ohno ..... D21/615
4,719,702 A * 1/1988 Hoffman ..... A47G 21/02 30/324
4,779,344 A 10/1988 Panisch
4,809,435 A * 3/1989 Printz ..... A47G 21/02 30/322
4,880,409 A * 11/1989 Bergkvist ..... A61J 7/0023 D7/653

(Continued)

FOREIGN PATENT DOCUMENTS

DE 202012004387 U1 * 1/2013 ..... A47G 21/02

*Primary Examiner* — Jason Daniel Prone
(74) *Attorney, Agent, or Firm* — Dale J. Ream

(57) ABSTRACT

A clandestine articulating utensil includes a body portion and a head portion, the body portion having a proximal end and a distal end opposite the proximal end. The head portion includes a lower jaw member fixedly attached to and extending away from the proximal end of the body portion and an upper jaw member pivotally coupled to the lower jaw member and having a neck section extending upwardly from a back of the upper jaw member. The upper jaw is movable between a closed configuration parallel and adjacent to the lower member and an open configuration angularly displaced from the lower jaw member. The clandestine articulating utensil includes a utensil coupled to and extending away from the distal end of the body member.

9 Claims, 7 Drawing Sheets

(56) References Cited

U.S. PATENT DOCUMENTS 4,961,717 A * 10/1990 Hickey ..... A46B 5/0095 132/308
D316,503 S * 4/1991 O'Grady ..... D7/643
5,056,173 A * 10/1991 Brincat ..... A47G 21/02 D7/644
D329,948 S * 10/1992 Hanner ..... D4/114
5,187,829 A * 2/1993 Atkins ..... A46B 5/00 D4/107
5,193,808 A * 3/1993 Takeshi ..... A63F 9/30 273/138.1
D347,146 S * 5/1994 Harrison ..... D4/107
D347,147 S * 5/1994 Harrison ..... D4/107
D347,148 S * 5/1994 Harrison ..... D4/107
5,353,464 A * 10/1994 Atkins ..... A46B 5/00 15/167.1
D364,075 S * 11/1995 Brogren ..... D7/648
5,655,303 A * 8/1997 Janczak ..... A47G 21/02 30/324
5,774,921 A * 7/1998 Harrison ..... A47G 21/02 D7/651
D397,744 S * 9/1998 Brummer ..... D21/615
5,946,807 A * 9/1999 Crane ..... A47G 21/02 30/324
6,105,254 A 8/2000 Crane et al.
D452,379 S * 12/2001 Cheong ..... D4/107
D529,767 S * 10/2006 Huber ..... D7/643
D535,149 S * 1/2007 Jonas, Jr. ..... D7/401.2
D622,784 S * 8/2010 Cohen ..... D7/656
D690,942 S * 10/2013 Thomas ..... D4/107
D690,993 S * 10/2013 Im ..... D7/401.2
D696,084 S * 12/2013 Frei ..... D7/653
D716,107 S * 10/2014 Skolnik ..... D7/655
D747,631 S * 1/2016 Rupp ..... D7/642
D747,777 S * 1/2016 Greenly ..... D21/615
D794,338 S * 8/2017 Griffin ..... D4/107
10,413,103 B1 * 9/2019 Balanchi ..... A47G 21/023
D876,839 S * 3/2020 Murillo ..... D4/107
10,625,171 B2 * 4/2020 Bae ..... A63H 3/46
D895,979 S * 9/2020 Burris ..... D4/107
10,959,554 B2 * 3/2021 Malcolm ..... A47G 21/04
D925,921 S * 7/2021 Burris ..... D4/107
D925,922 S * 7/2021 Burris ..... D4/107
D939,032 S * 12/2021 Chen ..... D21/615
2003/0088933 A1 * 5/2003 Woods ..... A46B 15/0089 15/167.1
2005/0034311 A1 * 2/2005 Crane ..... A47G 21/02 30/324
2005/0264017 A1 * 12/2005 Rauber ..... A47J 43/282 294/8

* cited by examiner

CLANDESTINE ARTICULATING UTENSIL

BACKGROUND OF THE INVENTION

This invention relates generally to infant feeding utensils and, more particularly, to a clandestine articulating utensil that includes jaw members that prompt an infant or toddler to imitate an action of opening one's jaws and that includes a spoon or fork configured to hold food for consumption by the infant. More particularly, the clandestine articulating utensil may include an animal figure at one end having jaws that may be articulated by a user between closed and open configurations and a utensil at an opposite end configured to hold food.

One of the biggest and often frustrating aspects of a parent or caregiver feeding an infant sitting in a highchair is gaining or keeping the infant's attention until all of the food stuff has been consumed by the infant. It is very common for the caregiver to open his own mouth and act interested in eating the food in an attempt to get the toddler to mimic the caregiver. Then, when the infant or toddler opens her mouth, the parent will insert the spoonful of food into the toddler's mouth. Therefore, creative ways to urge the toddler to open his mouth is always desirable.

Various devices have been proposed for using animal or cartoon figures to urge a child to open her jaws enough to insert a spoon of food. Some of the known devices or patent proposals even include figures having jaws that may be articulated between open and closed configurations. Unfortunately, however, the existing devices include complicated linkages and have jaws that actually face in the same direction as the utensil and, as result, face the child.

Therefore, it would be desirable to have a clandestine articulating utensil in which respective jaws of a figure are opposite and hidden from the utensil and the food it may hold. Further, it would be desirable to have a clandestine articulating utensil in which the articulation of upper and lower jaws is easy for the caregiver to operate, hides the utensil and food stuff from the child, and which gives the caregiver the option to swivel the device in order to feed the infant.

SUMMARY OF THE INVENTION

Therefore, a clandestine articulating utensil according to the present invention includes a body portion and a head portion, the body portion having a proximal end and a distal end opposite the proximal end. The head portion includes a lower jaw member fixedly attached to and extending away from the proximal end of the body portion and an upper jaw member pivotally coupled to the lower jaw member and having a neck section extending upwardly from a back of the upper jaw member. The upper jaw is movable between a closed configuration parallel and adjacent to the lower member and an open configuration angularly displaced from the lower jaw member. The clandestine articulating utensil includes a utensil coupled to and extending away from the distal end of the body member. It will be understood, however, the head portion and its jaws are functional to hold a food morsel (i.e. to "take a bite of food" which may then be fed to the child in a fun manner. In fact, even slightly older children may utilize the present articulating utensil to simulate the head portion taking a bit and the transferring the food morsel to his own mouth.

Therefore, a general object of this invention is to provide a clandestine articulating utensil having an animal or cartoon figure that urges a child to open her jaws in an entertaining manner and having a utensil that may then be rotated for insertion of a food portion into the then-open mouth of the child.

Another object of this invention is to provide a clandestine articulating utensil, as aforesaid, that essentially hides the utensil portion away from the child until the child willingly imitates the opening of a mouth of the figure member.

Still another object of this invention is to provide a clandestine articulating utensil, as aforesaid, that maintains the figure member and utensil along an imaginary longitudinal axis.

Yet another object of this invention is to provide a clandestine articulating utensil, as aforesaid, having a resilient construction that enables a user to manipulate the jaws of a figure between open and closed configurations.

Still another object of this invention is to provide a clandestine articulating utensil, as aforesaid, that may hold food at either end for transfer to a child, i.e. to provide a two ended utensil.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
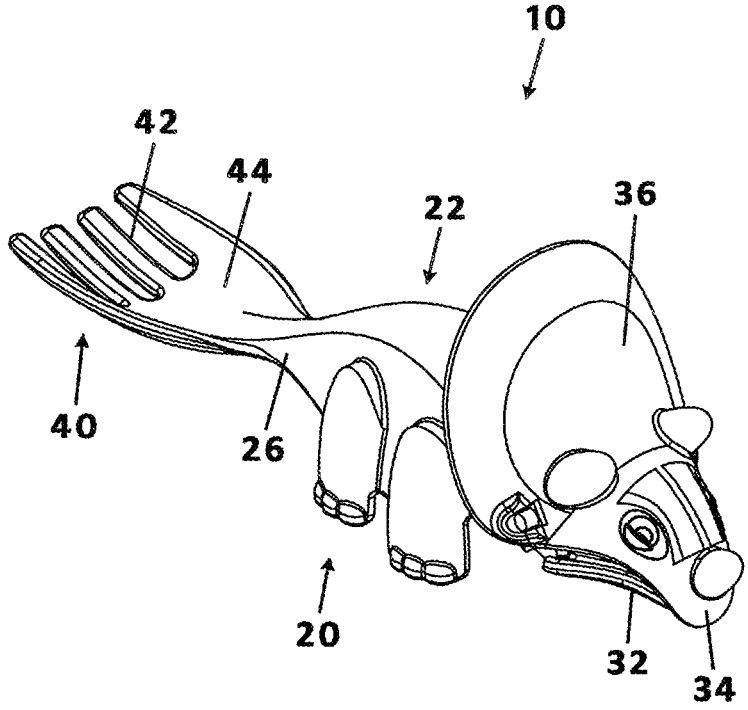
FIG. 1*a* is a perspective view of a clandestine articulating utensil according to a preferred embodiment of the present invention, illustrated in a closed configuration.

A clandestine articulating utensil according to a preferred embodiment of the present invention will now be described with reference to FIG. 1*a* to 7 of the accompanying drawings. The clandestine articulating utensil 10 includes a figure member 20 having a body portion 22 and head portion 30 and having a utensil 40 coupled to an positioned opposite the figure member 20 along a shared longitudinal axis.

An important aspect of the present invention is to have what will be referred to as a figure member 20 that provides a psychological urging of an infant or toddler to open his jaws for "one more bite" of whatever foodstuff a parent or caregiver wants the child to receive before a feeding event is brought to a close. In other words, every parent has at one time or another opened his own mouth in an attempt to have a "Pavlov's dog" effect on a baby to open his mouth—at which moment the parent inserts another bite of baby food or the like. Unfortunately, a parent may grow weary of repeatedly making the open mouth gesture or perhaps it becomes ineffective after a while.

All of the major components of the present invention will be viewed, explained, and are effective as being positioned along an imaginary longitudinal axis (referred to by reference character x). Specifically, the utensil handle, body portion 22, and head portion 30 may be streamlined and positioned linearly as will be described in more detail below.

Preferably, therefore, the clandestine articulating utensil 10 includes a figure member 20 having a body portion 22 and a head portion 30. Although the drawings associated with the present invention show the figure member 20 being a dinosaur, it is understood that the figure member 20 may be simulative and indicative of other animals, cartoon characters, or the like. The body portion 22 has a proximal end 24 (head portion end) and a distal end 26 (utensil end). The body portion 22 may include legs and other elements that lend to the accuracy of the animal being represented.

Similarly, the head portion 30 is constructed to accurately reflect the accuracy of the figure member 20 and to be properly associated with the body portion 22. More particularly, the head portion 30 may include a lower jaw member 32 that is fixedly attached to the proximal end 24 of the body portion 22 and is oriented to extend away from the body portion 22 along or generally parallel to the longitudinal axis x. The head portion 30 further includes an upper jaw member 34 pivotally coupled to the lower jaw member 32 and has a construction that may be pivoted or articulated between open and closed configurations as will be explained below in further detail.

Figure 1B:
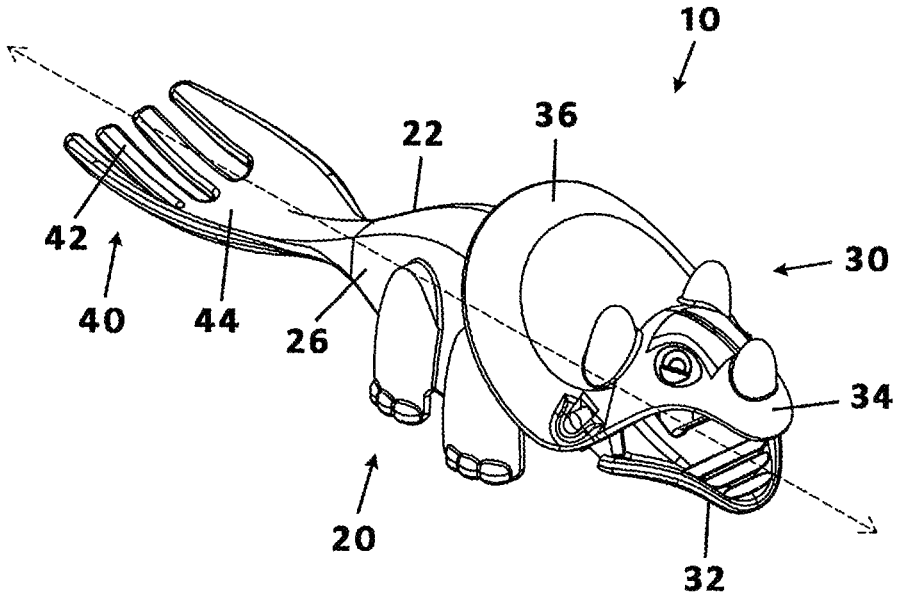
FIG. 1*b* is a perspective view of the clandestine articulating utensil as in FIG. 1*a*, illustrated in an open configuration.

The upper jaw member 34 (or the head portion 30 in general) may include a flange 36 extending upwardly therefrom and which is operable to cause the upper jaw member 34 to move between open and closed configurations. The flange 36 may also be referred to as a neck section or as a shield—each of which will utilize the same reference numeral 36. For instance, the figure member 20 may be indicative of a triceratops—a dinosaur having a low-slung neck and large neck "frill". In the present invention, this neck frill will be referred to as a neck section 36 of the head portion 30. The neck section 36 may be manipulated by a finger of a user (e.g. caregiver) and, by so doing, is operable to articulate and move the upper jaw member 34 between a closed configuration (i.e. a closed mouth configuration) as shown in FIG. 1*a*) and an open configuration (i.e. an open mouth configuration) as shown in FIG. 1*b*. At the closed configuration, the upper jaw member 34 is generally parallel to the lower jaw member 32 and is close in proximity. At the open configuration, the upper jaw member 34 is pivotally (upwardly and angularly) displaced from the lower jaw member 32 so that, together, the jaw members appear to be an open mouth.

Figure 2A:
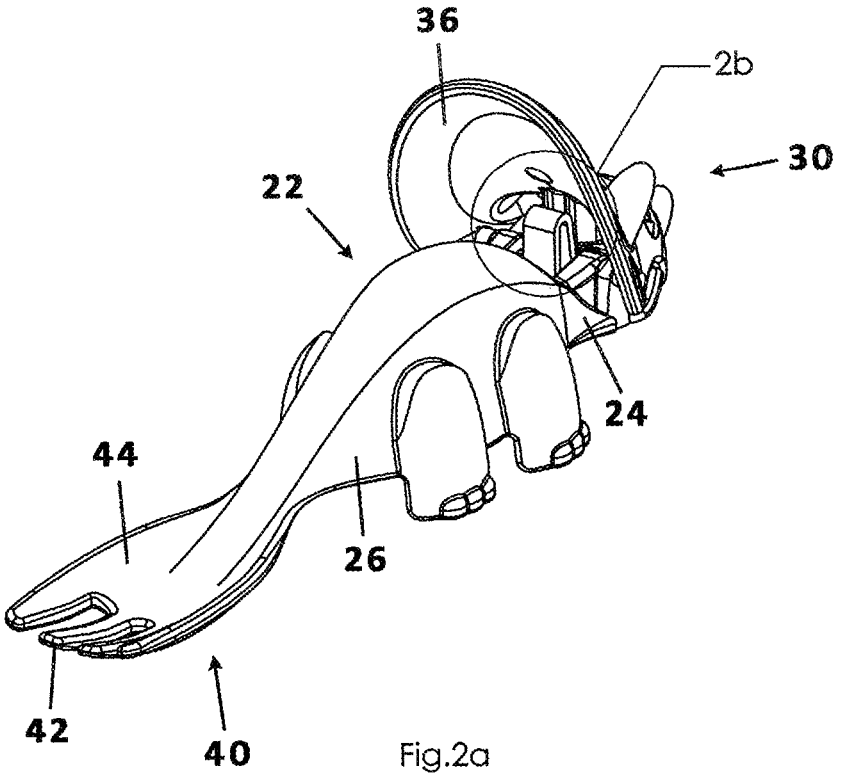
FIG. 2*a* is a perspective view from a rear angle of the clandestine articulating utensil as in FIG. 1*a*.
Figure 2B:
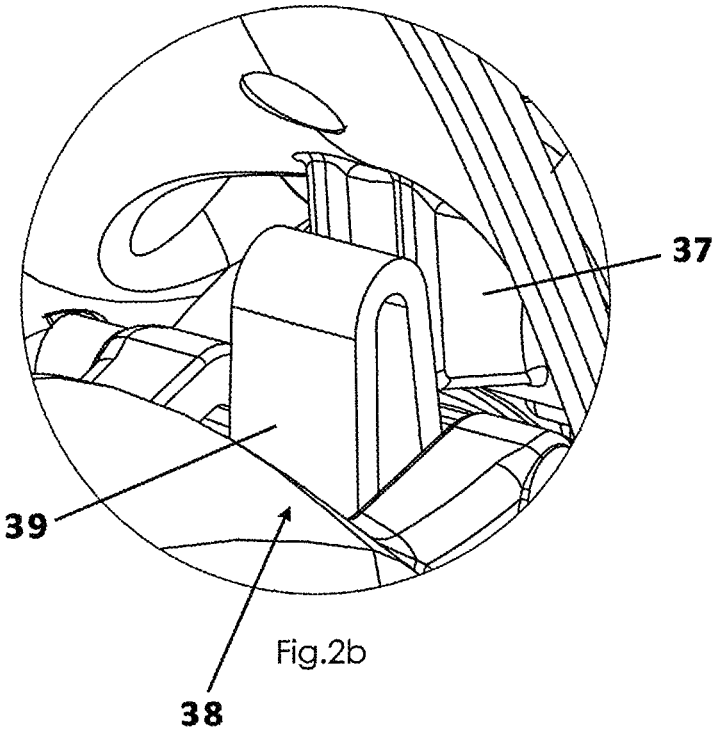
FIG. 2*b* is an isolated view on an enlarged scale taken from FIG. 2*a;*
Figure 3A:
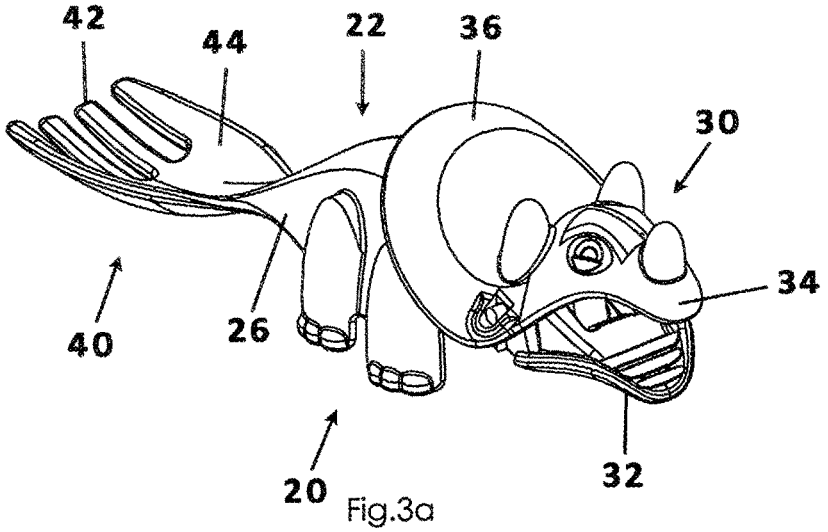
FIG. 3*a* is a perspective view of the clandestine articulating utensil as in FIG. 1*b;*
Figure 3B:
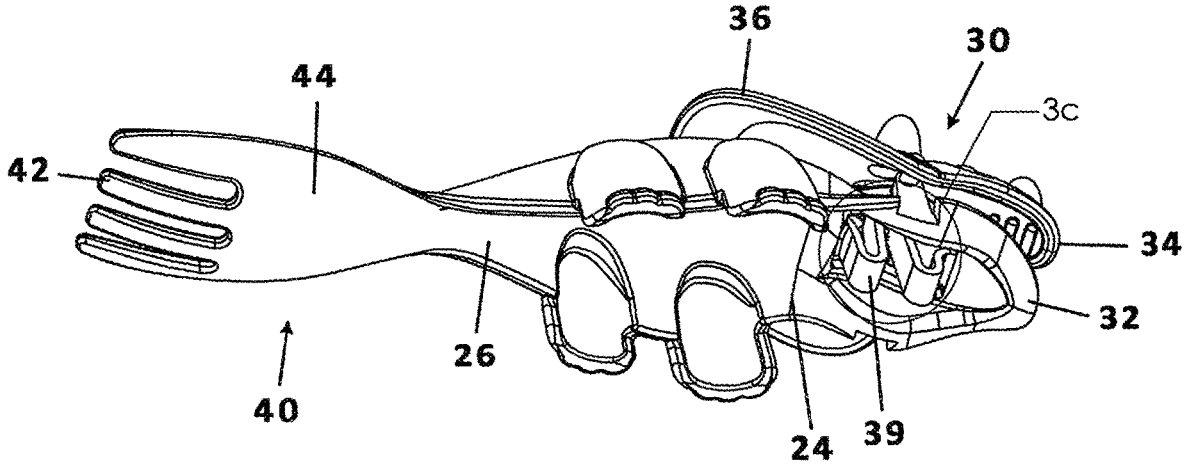
FIG. 3*b* is a perspective view from an underneath angle of the clandestine articulating utensil as in FIG. 3*a;*
Figure 3C:
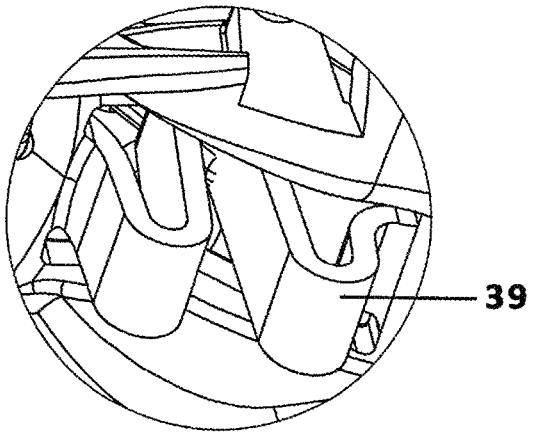
FIG. 3*c* is an isolated view on an enlarged scale taken from FIG. 3*b;*
Figure 4A:
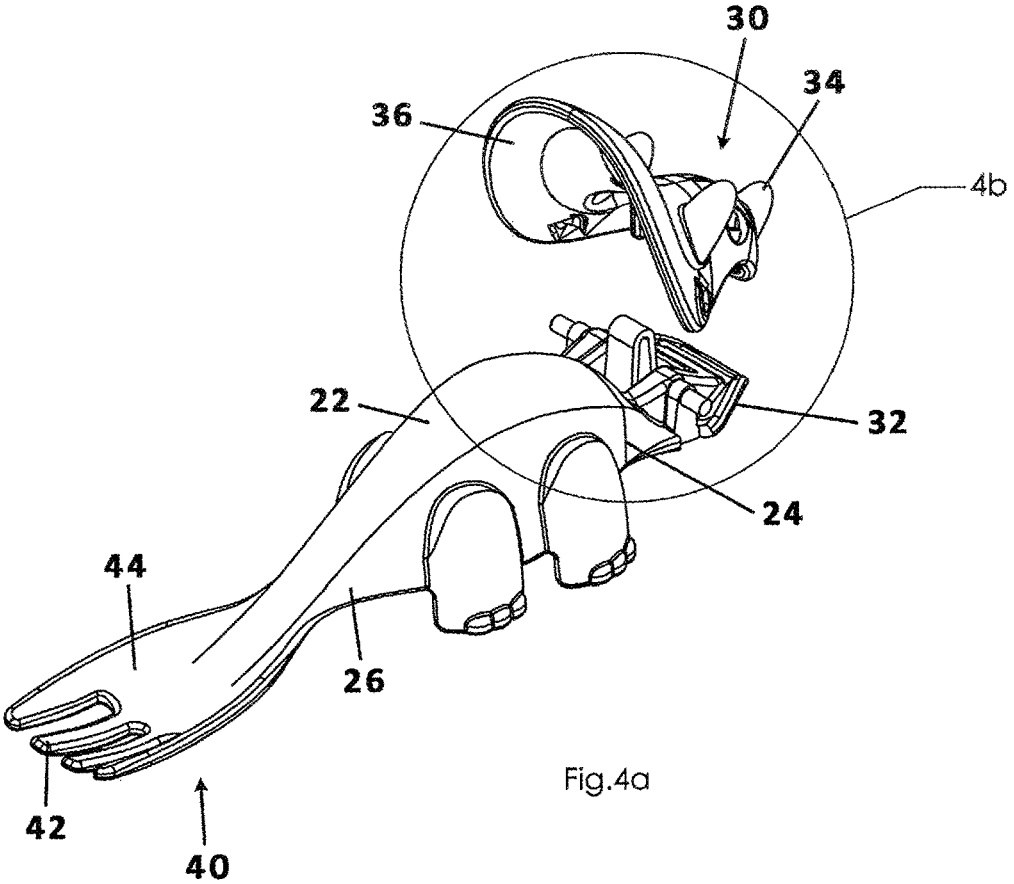
FIG. 4*a* is an exploded view from a reverse angle of the clandestine articulating utensil as in FIG. 1*a;*
Figure 4B:
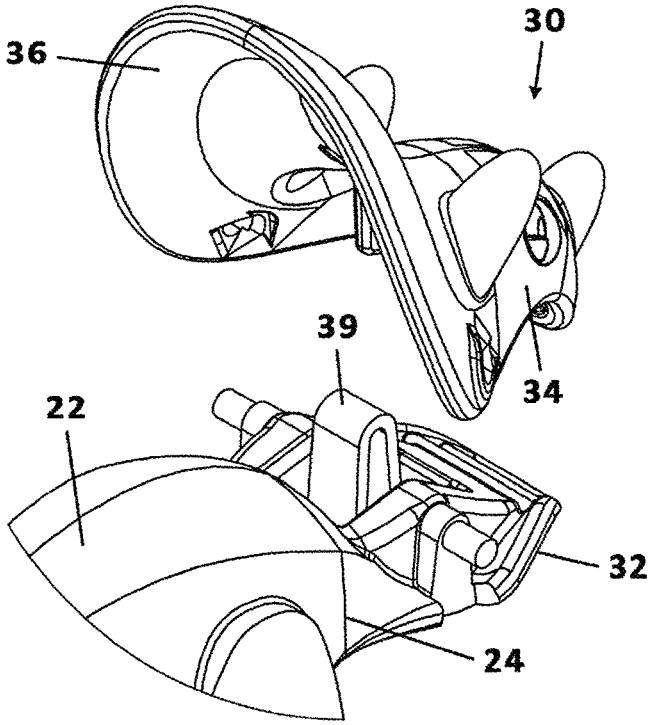
FIG. 4*b* is an exploded view of the clandestine articulating utensil as in FIG. 4*a* illustrated in a rotated configuration for clarity.
Figure 5A:
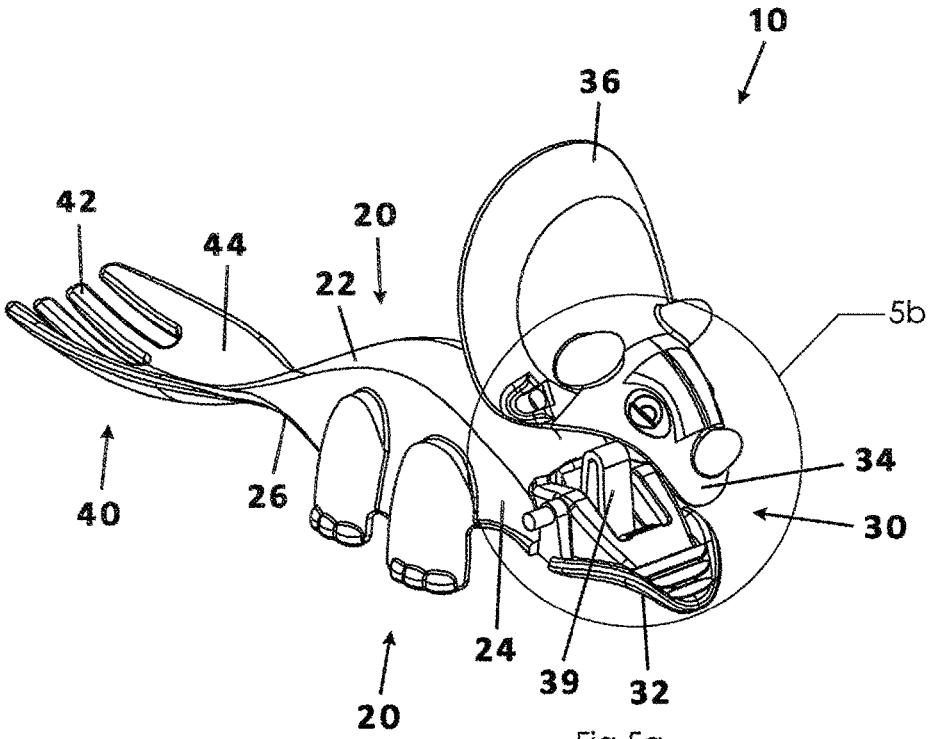
FIG. 5*a* is an exploded view of the clandestine articulating utensil as in FIG. 1*a;*
Figure 5B:
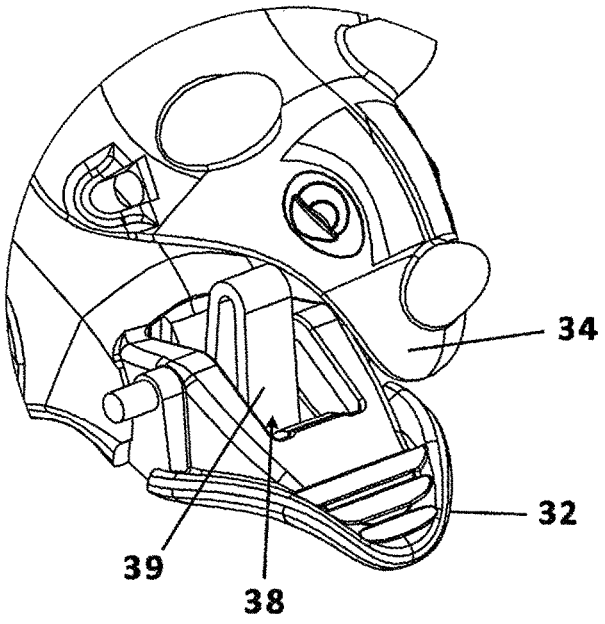
FIG. 5*b* is an isolated view on an enlarged scale taken from FIG. 5*a;*

In an embodiment, the clandestine articulating utensil 10 includes one or more elastic member 38 positioned between the jaw members for operably enabling the upper jaw member 34 to move between the closed and open configurations, the upper jaw member 34 being naturally biased toward the closed configuration. More particularly, the elastic member 38 may include one or more spring tabs 39 mounted to the lower jaw member 32 and extending toward the upper jaw member 34, i.e. such that a spring tab 39 is positioned in close proximity to the upper jaw member 34 and neck section 36 (FIGS. 2*b* and 3*c*). In use, when a user depresses the flange 36 downward and backward toward the neck section 36, the upper jaw member (or, specifically, a boss 37 coupled thereto) will impact and compress the spring tab 39 and the upper jaw member 34 is moved or articulated to the open configuration described above. Then, when the flange 36 is released, the spring tab 39 is no longer compressed and the upper jaw member 34 naturally and normally returns to its original configuration—namely, to the closed configuration.

In another aspect, an actual utensil 40 suitable for feeding a child extends from the distal end 26 of the body portion 22 of the figure member 20. More particularly, the figure member 20 may include a tail having a unitary construction with the distal end 26 of the body portion 22 and extending along the longitudinal axis x, the tail having the operability of being a handle of the utensil 40. The marketing concept is that the child may pretend or perceive that he is eating off of the tail of the animal. The utensil 40 extends away from the body portion 22 of the figure member 20 and has a terminal end in the form of either a fork or a spoon. More particularly, the terminal end of the utensil 40 may include a plurality of prongs 42 in the manner of a traditional child's fork and operable to hook and hold a food item for insertion into the mouth of the baby who is being fed. Similarly, the terminal end of the utensil may include a bowl 44 or concave structure in the manner of a traditional spoon operable to hold a food item, such as baby food, into the mouth of the baby being fed. Of course, the utensil may have a shaped configuration that is a combination of both a spoon and a fork, i.e. having a plurality of truncated prongs along with a bowl-shaped configuration.

Again, it is critical that the face of the figure member 20 extends in a direction opposite the terminal end of the utensil 40 so that the entire apparatus can be oriented figure member first in front of the baby and then, when desired, the apparatus is swiveled 180 degrees to insert the food item into the baby's mouth.

Figure 6A:
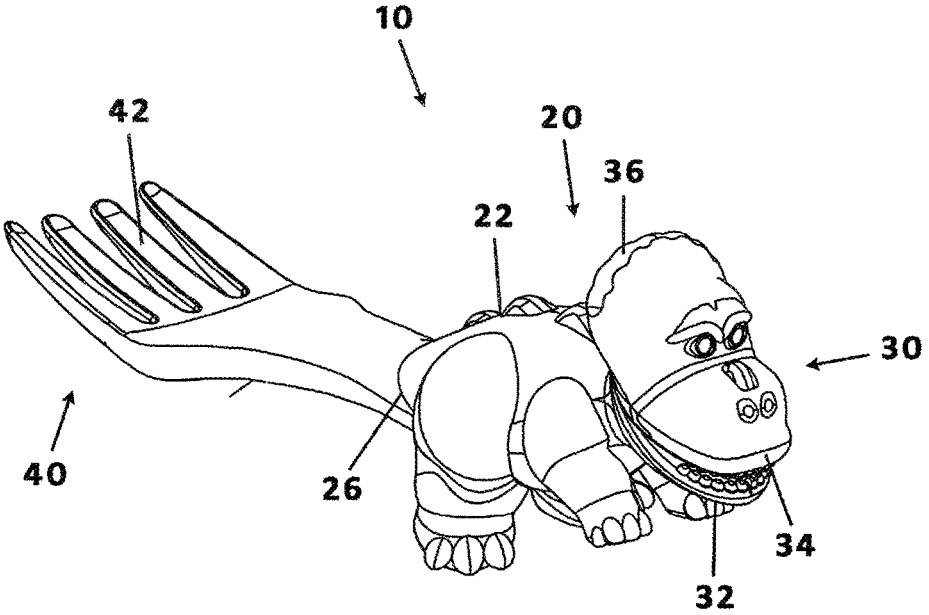
FIG. 6*a* is a perspective view of a clandestine articulating utensil according to another embodiment of the present invention.
Figure 6B:
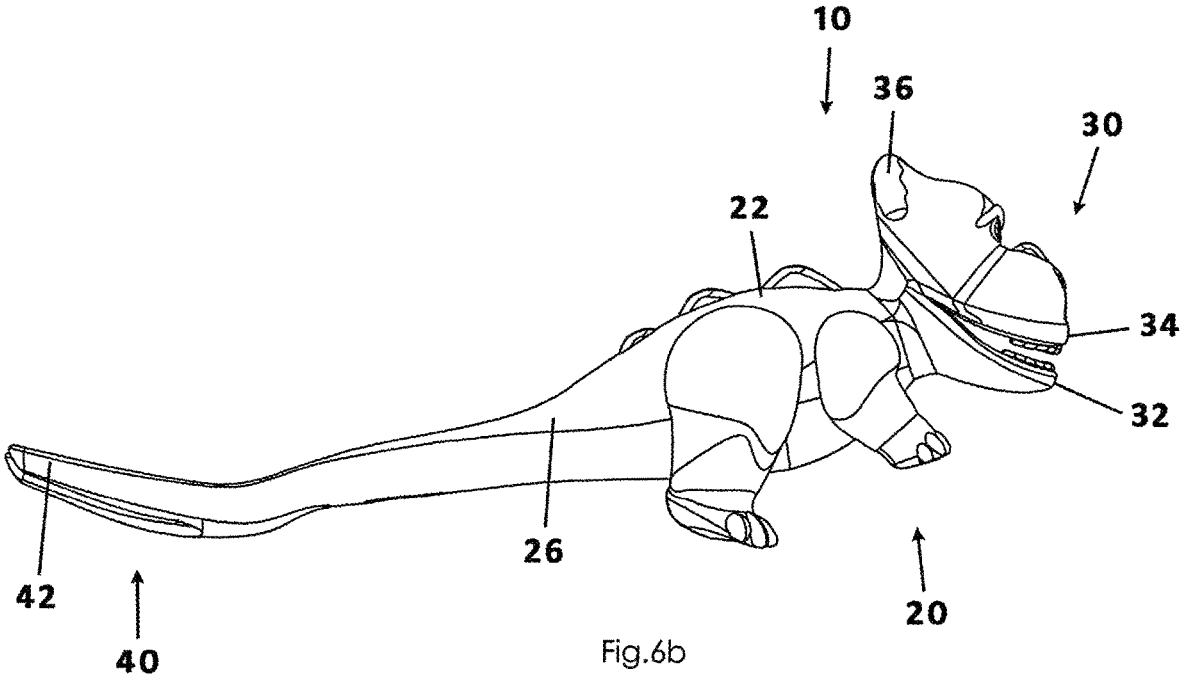
FIG. 6*b* a side view of the clandestine articulating utensil as in FIG. 6*a*.
Figure 7:
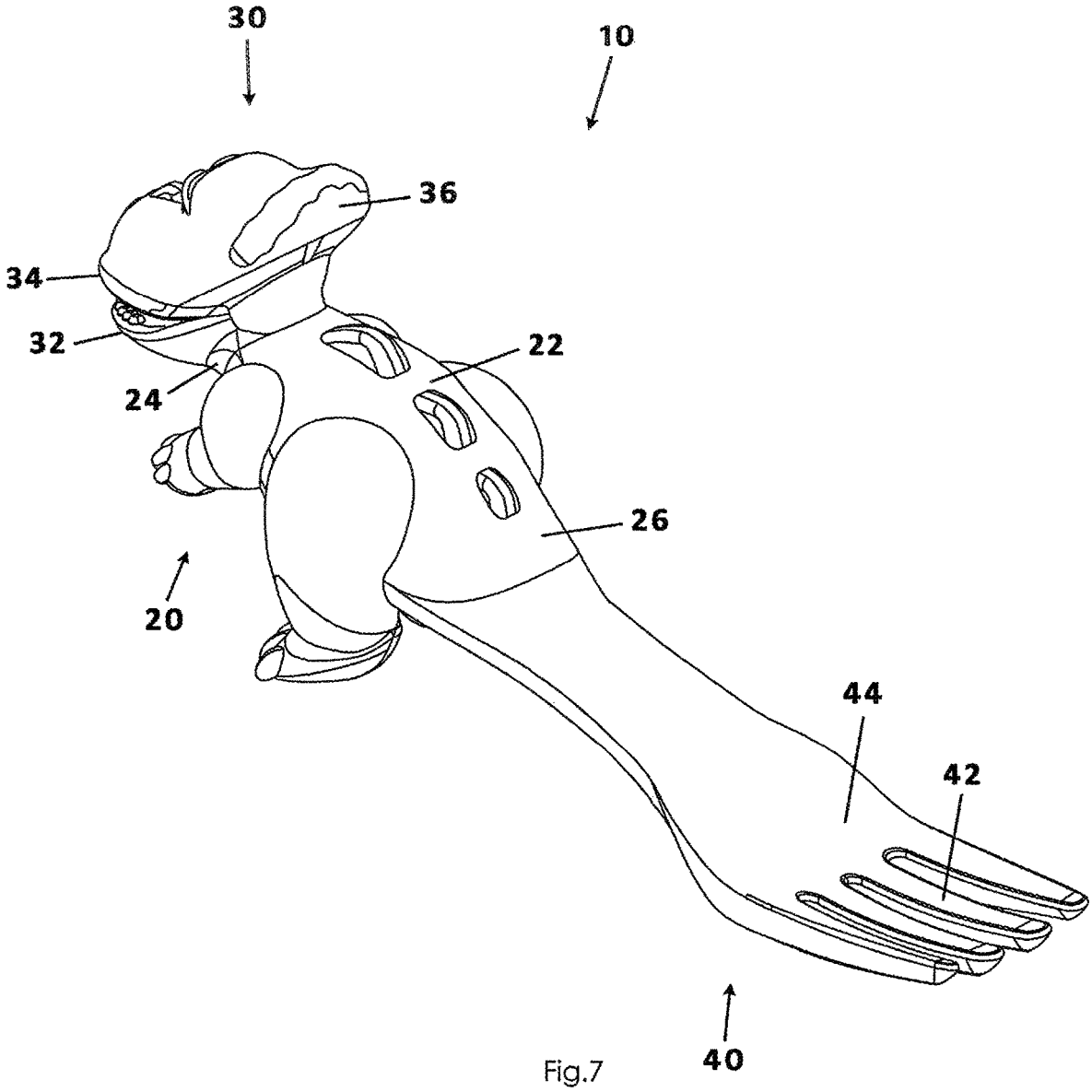
FIG. 7 is a perspective view taken from a reverse angle of the clandestine articulating utensil of FIG. 6*a*.

Another embodiment of the clandestine articulating utensil 10 is shown in FIGS. 6*a* to 7 and has a construction that is substantially similar to the embodiment first described except as specifically described below. More particularly, the figure member 20 may include a plastic frame having a rubberized layer atop the frame using a technique known as over-molding, i.e. the process by which a single part is made using two or more materials, such as by laying down one layer atop another. Using this technique, the figure member 20 may be constructed having an elasticity that enables the upper jaw member 34 to be moved between the open and closed configurations without mechanical components. Preferably, this embodiment still includes a flange 36 or neck section that a user can depress toward the body portion 22 and that is configured to raise or open the upper jaw member 34 when actuated and which allows the jaws to return to the closed configuration when pressure is released.

It is understood that while certain forms of this invention have been illustrated and described, it is not limited thereto except insofar as such limitations are included in the following claims and allowable functional equivalents thereof.

The invention claimed is:

1. A clandestine articulating utensil, comprising:

a figure member having a body portion and a head portion, said body portion having a proximal end and a distal end opposite said proximal end, said head portion comprising:

a lower jaw member fixedly attached to and extending away from said proximal end of said body portion;

an upper jaw member pivotally coupled to said lower jaw member and having a neck section extending upwardly from a back of said upper jaw member;

wherein said upper jaw member is pivotally movable between a closed mouth configuration in close proximity to said lower jaw member and an open mouth configuration angularly displaced from said lower jaw member;

a utensil coupled to and extending away from said distal end of said body member.

2. The clandestine articulating utensil as in claim 1, wherein said utensil and said lower jaw member defines an imaginary longitudinal axis having a linear configuration, said utensil and said lower jaw member extending away from one another along said imaginary longitudinal axis.

3. The clandestine articulating utensil as in claim 2, further comprising an elastic member mounted to and extending from said lower jaw member, said upper jaw member having a boss proximate said elastic member at said closed mouth configuration that bears against said elastic member so as to urge said upper jaw member toward said open mouth configuration.

4. The clandestine articulating utensil as in claim 3, wherein:

said elastic member is a spring tab; and said neck section is a flange extending away from said back of said upper jaw and includes a size dimension that masks or shields view of facial features of said upper jaw when simultaneously viewing said utensil along said imaginary longitudinal axis.

5. The clandestine articulating utensil as in claim 3, wherein said upper jaw member is urged by said elastic member toward said closed configuration.

6. The clandestine articulating utensil as in claim 1, wherein:

said utensil is a fork oriented in a direction extending away from said body portion of said figure member; and said fork includes a terminal end having a plurality of prongs configured to hold a foodstuff for consumption by a user.

7. The clandestine articulating utensil as in claim 1, wherein:

said utensil is a spoon oriented in a direction extending away from said body portion of said figure member; and said spoon includes a bowl region operable to hold a foodstuff.

8. The clandestine articulating utensil as in claim 1, wherein:

said figure member is indicative of an animal;

said distal end of said body portion is indicative of a tail of said animal and is operable as a handle for manipulation of said utensil.

9. The clandestine articulating utensil as in claim 1, wherein said figure member is indicative of a dinosaur.

* * * * *